US005573208A

United States Patent [19]

Cassagnes

[11] Patent Number: 5,573,208

[45] Date of Patent: Nov. 12, 1996

[54] PAPER KITE WITH FRAME

[75] Inventor: Andre Cassagnes, Vitry, France

[73] Assignee: Paimpol Voiles, S.A., Paimpol, France

[21] Appl. No.: 278,944

[22] Filed: Jul. 22, 1994

[30] Foreign Application Priority Data

Jul. 23, 1993 [FR] France ..... 93 09099

[51] Int. Cl.[6] ..... B64D 37/00

[52] U.S. Cl. ..... 244/153 R; 244/155 R; 244/154

[58] Field of Search ..... 244/153 R, 900, 244/901, 155 A, 155 R, 22

[56] References Cited

U.S. PATENT DOCUMENTS

| | | | |
|---|---|---|---|
| 2,785,870 | 3/1957 | Green | 244/153 R |
| 3,746,286 | 7/1973 | Christoffel | 244/155 A |
| 4,807,832 | 2/1989 | Tabor | 244/153 R |
| 4,813,637 | 3/1989 | Bondestam | 244/153 R |
| 4,927,100 | 5/1990 | Provenzo, Jr. et al. | 244/153 R |

FOREIGN PATENT DOCUMENTS

| | | | |
|---|---|---|---|
| 20811 | of 1908 | United Kingdom | 244/22 |
| 4230 | of 1908 | United Kingdom | 244/22 |

OTHER PUBLICATIONS

French Search Report.

*Primary Examiner*—Andres Kashnikow
*Assistant Examiner*—Tien Dinh
*Attorney, Agent, or Firm*—Laff, Whitesel, Conte & Saret, Ltd.

[57] ABSTRACT

A kite of the type that comprises a main frame with longitudinal rods (10, 12, 13) and transverse rods (11, 11'), has a secondary frame comprising rods known as "whiskers" (2). These rods (2) are extended to meet at a junction point (22) located in the median plane of symmetry. According to a first embodiment, straps (23, 24), either elastic or not elastic, stretch these rods (2). According to a second embodiment, an additional sail forms a keel, this sail being stretched between the median longitudinal rod (10) and the point of junction (22).

10 Claims, 2 Drawing Sheets

PAPER KITE WITH FRAME

The present invention relates to a kite of the type with frames which stretch its sail or sails.

Generally, kites with frames in reality have two types of frames:

the frames that constitute the very skeleton of the kite, connected among themselves in a quasi-rigid manner, and that form a kind of lattice work in a same plane;

other frames, generally lighter ones that may be called secondary frames, that take their support on the main frame, and that come to push or force the sail outside the plane of that main frame. These frames are not necessarily indispensable, and the kite may possibly fly without the secondary frames.

In the following, there will be considered the case of a kite of the "Delta" type, without this in any way limiting the scope of the present invention.

The main frame then is usually constituted as follows:

a median longitudinal rod reaching as far as the head of the kite. It is either located inside a sheath, or placed as a support behind the sail;

two lateral longitudinal rods, that also reach as far as the head of the kite; they are located inside a sheath of the sail;

one or several transverse rods that connect together the longitudinal rods: they are not in direct contact with the sail, but are fixed on the longitudinal rods.

The secondary frame, for its part comprises, in the present state of the art, one or several pairs of small rods or connectors that take their support on one side of the transverse rods and that come, on the other side, to stretch or push the sail or other floating frames outside the plane of the main frame.

The present invention more especially relates to this second type of frame using connectors called, depending on the countries, "Whiskers", "wiskers", "stand off" connectors, "stretchers," "pushers", etc. In the following, and for the sake of simplification, this type of frame will be called stand off connectors "Whiskers".

The support of the stand off connectors or whiskers on the transverse rods presents numerous drawbacks:

deformation of the main frame, that becomes curved under the stress of these connectors or whiskers' pressure: there results from this a modification of the kite's shape and of its flight;

difficulty of exerting an important force, since the support becomes deformed;

embrittlement of the transverse frames: the latter are subjected, during the flight, to a compression force, and any transverse secondary force tends to cause them to buckle and to break;

lack of constancy in the holding of the sail, because of the deformations of the main frame that depend on the wind pressure;

difficulty in correctly positioning these stand off connectors or "whiskers" so that they would push on the sail with a good incidence, since they must take their support on a transverse rod and that, even when the position is not ideal.

The present invention has as its object to obviate the drawbacks of the prior art, some of which have just been recalled.

To that end there is provided for a secondary frame that always comprises at least one pair of "whiskers" but differently arranged.

More precisely, the ends of each pair of whiskers are extended, until they come and take their support on each other in the median plane of symmetry. These two ends then can be positioned in an optimized manner within this plane, and the holding of this position is executed by a simple fastening together that comprises at least one side on the central rod.

The present invention therefore has as its object a kite of the type that comprises at least one sail and one main frame made up of longitudinal and transverse rods, and a secondary frame comprising additional stand off connectors that stretch the rear edge of the sail or that give a curve to the latter, the kite being endowed with a median plane of symmetry; characterized in that additional rods, whiskers, or stand of connectors come to take their support on a structure at a junction point located in the median plane of symmetry.

It thus makes it possible to avoid all of the above-indicated drawbacks:

deformation of the frame;

possibility of important tension;

no brittlement of the transverse rod;

no deformation in the keeping of the shape;

positioning of the "whiskers" without stress.

Simultaneously, there are obtained the following complementary advantages:

possibility of causing variations in the slant of the "whiskers" by a simple adjustment of the straps.

possibility of using elastic straps or ties that compensate for, or that absorb the wind variations and thus make the kite noiseless whatever the wind might be.

Furthermore, in an additional mode of execution, it is possible to use a small complementary sail that forms a keel or fin in the median plane. This keel or fin presents several advantages: guiding the kite by stabilizing its trajectory, something that is important during take offs; slowing down the kite and breaking its inertia in a very tight looping, something very important to slow down a kite and cause it to land.

In this mode of execution, it is possible:

to use a more or less porous material for this keel or fin, that limits the stabilizing effect;

to use a keel or fin with a sail center placed far to the back, while adjoining a rigid leading edge to this keel or fin.

The kite being supported on its keel, it gets back into the wind by itself, without it being necessary to turn it over, or to have the help of another person.

Finally, the two whiskers being connected together, there is created a rudder bar that balances the tension between the two wings, especially in turns.

The present invention will be better understood, and others of its characteristics and advantages will appear upon reading of the following description, and in relation to the attached figures among which:

Figure 4:
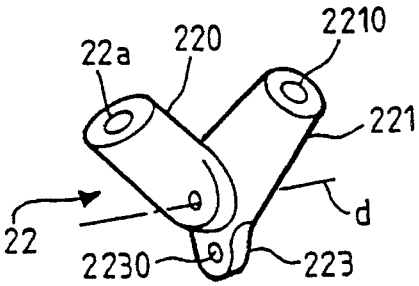
Figure 3:
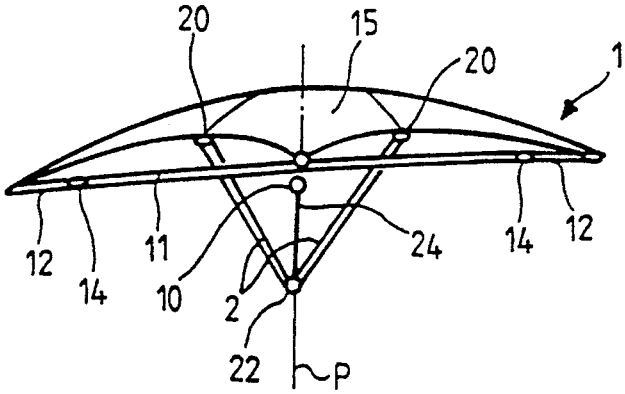
Figure 5:
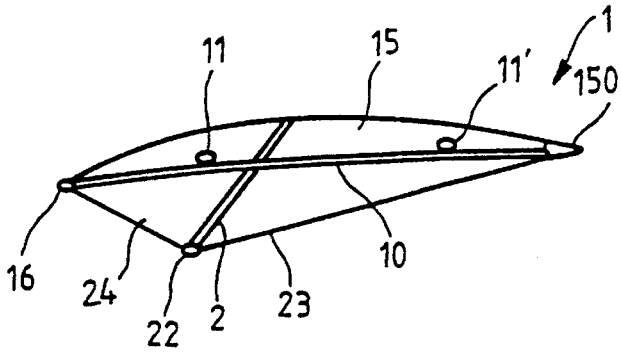
Figure 6:
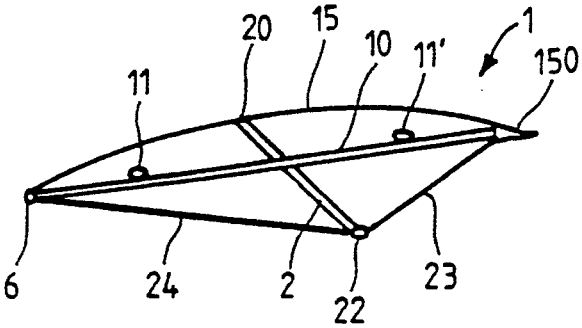
Figure 7:
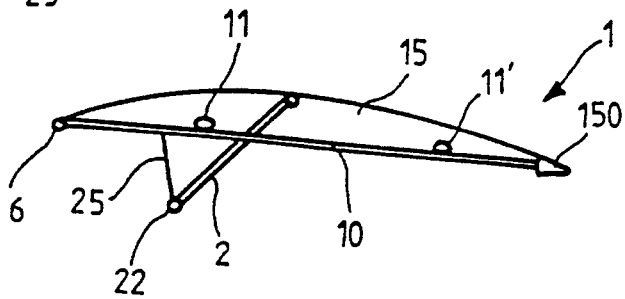
Figure 8A:
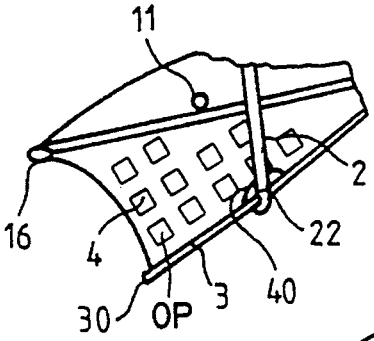
Figure 8:
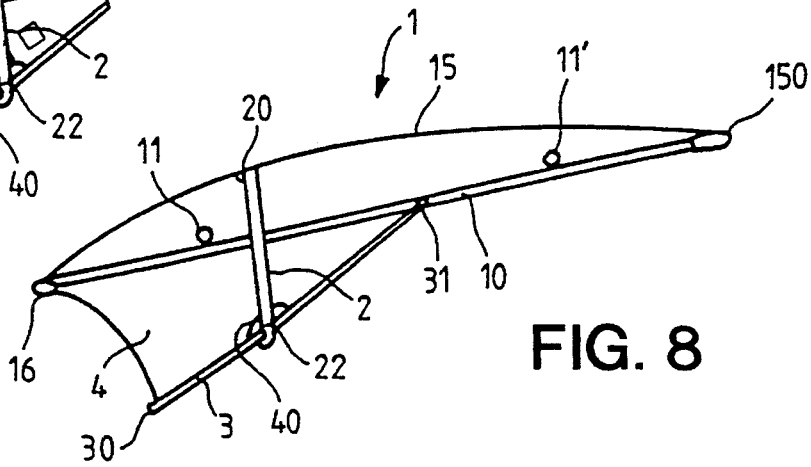

FIG. 3 schematically illustrates this same kite, seen from the rear;

FIG. 4 illustrates a detail element of this kite;

FIGS. 5 and 6 illustrate variations of this embodiment;

FIG. 7 illustrates an additional variation of this embodiment;

FIG. 8 illustrates a second mode of execution of a secondary frame according to the invention; and FIG. 8A is a fragment of FIG. 8 with openings that form a keel sail into a grid that stabilizes the kite.

Figure 1:
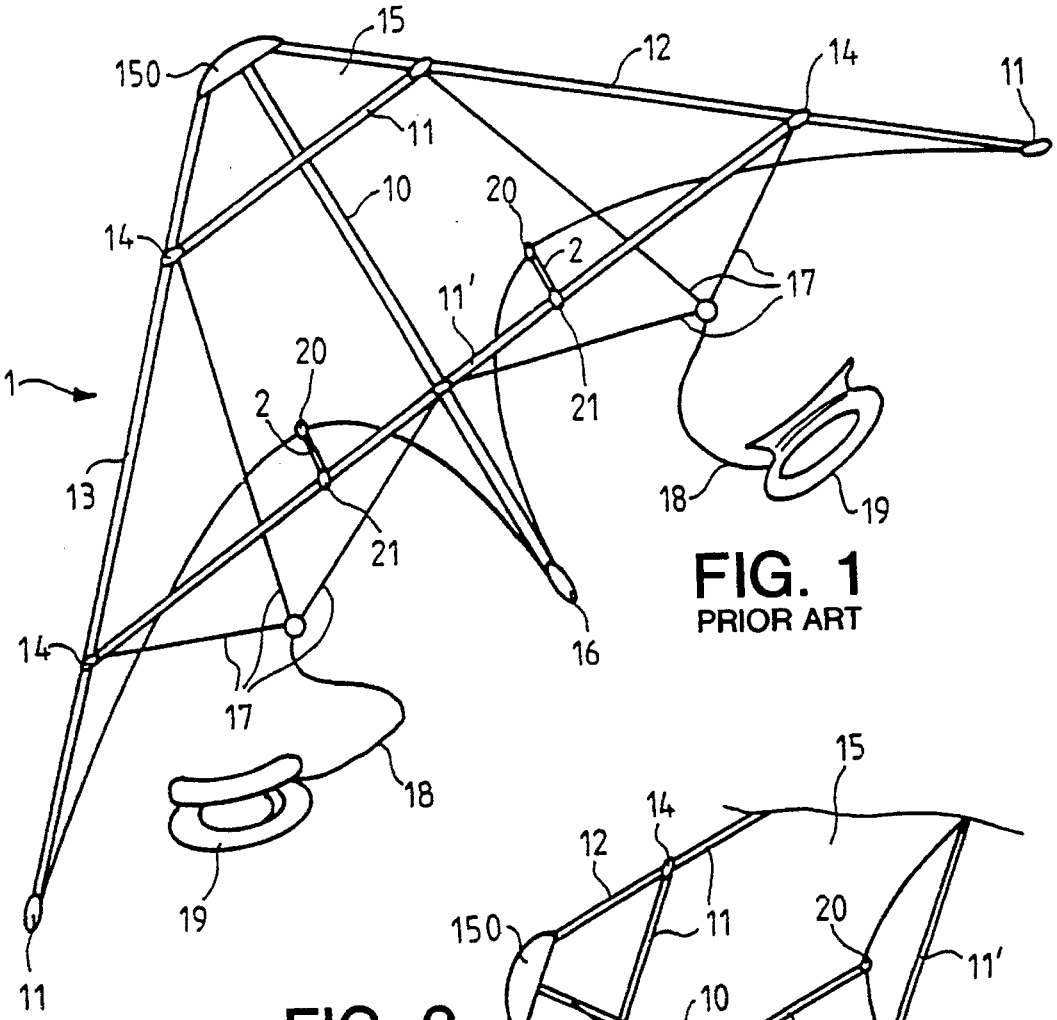
FIG. 1 PRIOR ART
FIG. 1 shows a kite of the "Delta" type comprising a secondary frame equipped with "whiskers" according to the prior art.

FIG. 1 shows a kite 1 of the "Delta" type according to the prior art. It comprises a main frame formed, as already indicated, of a median longitudinal rod 10, of one or several transverse rods 11, 11' (in the example illustrated), that connect between them two longitudinal rods 12 and 13. The transverse rods are not in contact with the sail 15 of the kite 1, but they are affixed to the longitudinal rods by means of junctions 14. These junctions 14 are, for example fixed on the rods 12, 13 and they have an opening into which there are threaded the ends of the transverse rods 11, 11'.

Still in the example being illustrated, the fore part of the sail 15 comprises a sheath 150 into which there are threaded the rods 10, 12 and 13.

Sail 15 is fixed on the rear end of the rods 10, 12 and 13 with conventional fixation means (elastic slits for example).

Two sets of straps 17 are provided to distribute as well as possible the forces exerted on two directional cables 18 of the kite 1, themselves rolled over a pair of governing handles 19, on the frame of the kite 1, and thus to obtain a directing of the flight.

To that end, in the example illustrated, the straps 17 of each set are connected at one of their ends, to the lateral rods 12, 13 on the one side, and to the central rod 10 on the other side.

In the prior art, the secondary frame especially comprises one or several pairs of whiskers 2, that are connected at one of their ends to the sail 15, by tying means 20, and that take their support, at their other end, on the transverse rod or rods, in this case (on) the transverse rod 11 in the illustrated example. There are provided, to that end, junctions 21 of a type similar to junctions 14.

This arrangement has the drawbacks that have been indicated above.

There will now be described a first embodiment of a kite according to the present invention, and more especially an embodiment of its secondary frame with reference to the FIGS. 2 and 3.

In these figures, as well as in the other figures attached to the present description, elements that are identical or similar to those in FIG. 1, have the same reference and they will be described only as need be.

Figure 2:
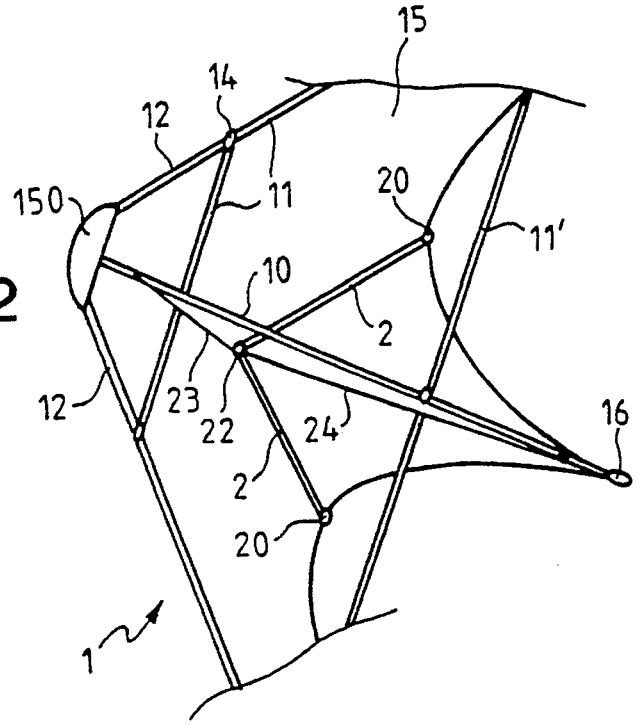
FIG. 2 is a partial view of a kite comprising a secondary frame according to a first embodiment of the invention.

FIG. 2 partially illustrates a kite 1 of a type similar to the one in FIG. 1, but that incorporates the provisions particular to the present invention.

FIG. 3 schematically illustrates this same kite 1, seen from the rear.

The main frame is absolutely similar to the one described above, because it is not directly affected by the present invention. It is therefore useless to describe it again. For the sake of simplification, there have been shown neither the guiding straps 17, nor the cables 18 and handles 19 (FIG. 1).

According to one of the important characteristics of the invention, the pair or pairs of whiskers 2 do not take their support on the transverse rod or rods, rod 11 in the example of FIG. 2, but they extend until they meet in the median plane P (FIG. 3) of the main frame of the kite 1.

The corresponding ends of the whiskers are connected to each other by any suitable junction means 22. The latter may be a junction in two parts 220 and 221 as shown in FIG. 4. These two parts 220 and 221 may be movable in rotation around a shaft d and they have openings 220 and 2210, respectively into which there can be introduced the ends of the wiskers 2 to be connected. Their other ends are fixed in 20 to the sail 15, in a conventional manner.

According to another aspect of the present invention, the whiskers are held in a fixed position relative to the main frame, by means of straps 23, 24, or of similar means.

These straps 23, 24 are attached, by one end to junction 22 and by their other end to the median longitudinal rod 10, toward the front and toward the rear, respectively, of the kite 1.

Junction 22 advantageously is equipped with a tie means 223, in its lower part for example, that is itself equipped with an opening 2230, or with any other similar means: hook, ring, etc.

The straps 23, 24 form a V-shaped structure located in the median plane P (FIG. 3), while the pair of whiskers 2 also forms a V-shaped structure, but mutually perpendicular with the preceding one.

The present invention offers the advantage that it is possible to position the junction point 22 at will within plane P. (FIG. 3)

On the one part, the distance that separates the junction point 22 from the rod 10 depends on the effective length of the whiskers 2.

On the other part, as seen in FIGS. 5 and 6 that schematically show the kite 1 in side view, the junction point 22 may be placed toward the rear, as for example in FIG. 5, toward the front, or at any other point depending on the respective lengths of the of the straps 23, 24.

These adjustments that serve, among other things, to determine the slant of the whiskers 2 toward the front or toward the rear, therefore can be made very simply. As a result, it is possible to obtain different flight behaviors for the kite 1.

It is further possible to cause variations in the tension of whiskers 2 simply by playing with the tension of the straps 23, 24.

According to a first mode of execution, the tying elements that form the straps 23 and 24 are made of non-elastic material, of webbing or of string material type for example.

These straps 23 and 24, however, may be executed of an elastic material, this making it possible, as already indicated, to compensate for or to "absorb" the wind variations (gusts, etc.) and thus they make the kite 1 especially noiseless whatever may be the flight conditions.

This function may also be performed by the secondary frame alone as well as a complement to that of the straps. More specifically, it suffices to make the whiskers of elastic material, something that is generally done.

It is also possible, in a variation that is not shown, to provide for a pattern of more complex straps that have one of their ends attached to various elements of the frame.

Until now, it has implicitly been assumed that the number of straps associated with each pair of whiskers 2 was at least equal to two.

In reality, as illustrated in FIG. 7, a single straps 25 is sufficient, this making it possible to simplify the secondary structure.

As a function of the tie point along the central rod 10, the pair of whiskers 2 will be more or less slanted toward the front, or toward the rear of the kite 1.

Strap 25, of course, may be either rigid or elastic.

FIG. 8 illustrates a second mode of execution of a kite according to the present invention.

The main teaching, that is to say the extension of the whiskers 2 and the junction of their ends, opposite their ends connected to sail 15, in a point 22 located in the median plane P (FIG. 3) of course is preserved.

According to this embodiment of the invention, however, there is added an additional sail 4, placed at the tail of the kite 1. This sail 4 serves as a keel or fin in the median plane P (FIG. 3). It is stretched either by means of the whiskers 2, or directly by the use of an additional rod 3, as shown in FIG. 8.

This additional rod 3 takes its support by one of its ends on the median longitudinal rod 10, by means of a junction element 31 similar to elements 14 (FIG. 1).

The additional sail 4 may be tied to its other end in 30, in a manner similar to the tying means 16 (FIG. 1). There can be provided in the sail 4 a sheath through which rod 3 is threaded to fix it to the junction point 22.

The junction element 22, such as illustrated in FIG. 4, besides, may be fixed on rod 3. It is sufficient, for example, to provide for an opening 220 with a diameter sufficient to thread rod 3 through it.

It is also possible to provide for a sheath in sail 4, through which to thread rod 10.

According to this mode of execution, the straps 23 and 24 become useless.

The fact of rendering rigid the leading edge of the sail makes it possible to adopt for the keel a shape that permits the regulating of the center of gravity of its sail 15.

If, however, contrary to the example shown in FIG. 8, no additional rod 3 is used, the additional sail 4 then will have an approximately V-shaped cut-out connected on the one part to the rod 10 in two extreme points at least and, on the other part to the junction point 22. In a preferred manner, the rod 3 is threaded through the additional sail 4 by means of a sheath.

According to this variation, not shown, it is the sail itself that plays the part of the straps 23, 24.

As already indicated, the use of a keel or fin proves interesting in several ways, especially in that it can guide the kite 1 by stabilizing its trajectory, slowing it down and braking its inertia when a tight looping is executed, and cause it to land.

The additional sail 4 may be made of different materials, more or less porous, this making it possible to limit the stabilizing effect to a determined degree, depending on the kite model.

Sail 4 may be equipped with openings (FIG. 8A) evenly distributed to form a keel. The openings such as OP may form the sail into a grid.

The present invention, of course, is not limited to the sole variations in execution that have been specifically described, especially with respect to FIGS. 2 to 8.

In particular, it should not be limited to the sole kites having the general shape of a "Delta", this common shape being retained only in order better to describe the invention.

It applies to any kite equipped with a main frame meant to stretch its sail or sails, and with a secondary frame of the type using pairs of elements known under the name of "whiskers", such as defined in the present description.

It must be recalled here that the main frame of the kite is not directly involved in the provisions of the invention.

As indicated above also, the number of these pairs of whiskers is not limited to one. It is just as possible to use two or even more pairs of them, depending on the type of kite.

It must be specified that one of the advantages of the invention that has not been indicated above is found in the fact that, at landing, a kite according to the present invention does not rest flat on the ground, but it rests on the common ends 22 of the whiskers 2 in the cases shown in FIGS. 3, 5, 6 and 7, and on the end 30 of the additional rod 3 in the case of FIG. 8, (all of them) ends that are located below the plane containsing rod 10 especially. There results from the above that, even though the kite rests on the ground, the wind nevertheless is caught in sail 15 and that it is possible to cause it (the kite) to go up again by means of a simple tension exerted on the leading cables 18, that is to say easily, contrary to the kites of the prior art that must be replaced to face the wind.

I claim:

1. A kite (1) comprising at least one sail (15) and a main frame made up of a plurality of longitudinal and transverse rods (10, 11, 11', 12, 13) that stretch said sail (15), and a secondary frame comprising whiskers (2) that stretch the rear edge of the sail (15) to shape the sail (15), said whiskers (2) being supported on a structure (23 to 25, 3) at a junction point (22) located in a median plane of symmetry (P) of the kite (1).

2. The kite (1) according to claim 1, characterized in that said structure comprises at least one string (23, 24, 25) having one end affixed to at least one of said longitudinal rods (10) of the main frame, and the other end of which is affixed to said junction point (22).

3. A kite (1) according to claim 2, wherein said structure is adjusted by means of the tension of said at least one string (23, 24).

4. A kite (1) according to either one of the claims 2 or 3, wherein the kite (1) is subjected to variations in the wind intensity, and the string or the secondary frame is made of elastic materials, the elasticity maintaining a tension for the sail (15) despite the deformations of the frames that result from said variations in the wind intensity.

5. A kite (1) according to either one of the claims 2 or 3, wherein there are a plurality of said strings and the relative lengths of said strings are adjusted so as to impose a slanting of the whiskers (2) toward one of a front or a rear of the kite (1), the junction point (22) remaining in said median plane of symmetry (P).

6. A kite (1) according to claim 1, wherein said structure comprises an additional sail (4) that forms a keel located in the median plane of symmetry (P), so as to stabilize the kite (1).

7. A kite (1) according to claim 6, characterized in that said additional sail (4) is made of a porous material.

8. A kite (1) according to claim 6, characterized in that the additional sail (4) is equipped with openings that form a grid.

9. A kite (1) according to any one of the claims 6 to 8, wherein said structure comprises means to make rigid the leading edge of the additional sail (4), so as to push back the center of gravity of the keel sail (4).

10. A kite (1) according to claim 9, wherein said means to make rigid the leading edge of the additional sail (4) is a longitudinal keel rod (3) that takes its support by one of its ends on said longitudinal main frame rod (10) located within said median plane of symmetry (P).

* * * * *